US007258458B2

(12) United States Patent
Mochiachvili et al.

(10) Patent No.: US 7,258,458 B2
(45) Date of Patent: Aug. 21, 2007

(54) AUTOMATIC BASE-MOUNTED CONTAINER ILLUMINATOR

(76) Inventors: Michael Mochiachvili, 330 E. 38th St., New York, NY (US) 10016; Dennis Glenn, P.O. Box 544, Plainview, NY (US) 11803

( * ) Notice: Subject to any disclaimer, the term of this patent is extended or adjusted under 35 U.S.C. 154(b) by 252 days.

(21) Appl. No.: 11/088,453

(22) Filed: Mar. 24, 2005

(65) Prior Publication Data

US 2005/0213314 A1 Sep. 29, 2005

Related U.S. Application Data

(60) Provisional application No. 60/556,524, filed on Mar. 26, 2004.

(51) Int. Cl.
*F21V 33/00* (2006.01)

(52) U.S. Cl. ..... 362/96; 362/318; 362/101

(58) Field of Classification Search ..... 362/96, 362/101, 318

See application file for complete search history.

(56) References Cited

U.S. PATENT DOCUMENTS 3,158,060 A * 11/1964 Semenoff et al. ..... 89/1.55
5,447,764 A * 9/1995 Langford ..... 428/36.9
5,743,620 A * 4/1998 Rojas et al. ..... 362/101
5,785,407 A * 7/1998 Ratcliffe et al. ..... 362/101
6,984,797 B2 * 1/2006 Morita et al. ..... 200/314

* cited by examiner

*Primary Examiner*—Renee Luebke
(74) *Attorney, Agent, or Firm*—Charles E. Temko

(57) ABSTRACT

The Automatic Base-Mounted Container Illuminator is a new and improved illumination device for use and attachment on the base of a liquid container. The Illuminator attaches to the container due to a high level of friction between the outer surface of the container and the outer surface of the Illuminator's liquid-proof coating. The Illuminator contains a power source and a light source. The power source and light source are connected by an electrical switch mechanism so that when the liquid container and attached Illuminator are lifted from a standing position the circuit is completed until the container is placed back onto its base in a standing position. When the Illuminator is engaged the liquid and the bottle itself become illuminated. This effect is useful for advertising and attracting business, and it is pleasing to the eyes of nearby observers. Thus, the Illuminator can be simultaneously used as an advertising agent and a visual stimulant.

3 Claims, 7 Drawing Sheets

AUTOMATIC BASE-MOUNTED CONTAINER ILLUMINATOR

CROSS REFERENCE TO RELATED APPLICATIONS

We claim benefit to the earlier filed provisional application, No. 60/556,524, filed on Mar. 26, 2004, pursuant to 35 U.S.C. 119(e).

BACKGROUND OF THE INVENTION

1. Field of the Invention

The present invention relates to a novelty item in the form of an automatic base-mounted container Illuminator (hereinafter "Illuminator") that attaches to the base of a liquid container and has a light source therein. The Illuminator incorporates an electrical switch mechanism that causes the device to engage and illuminate the liquid container when the liquid container and attached Illuminator are lifted from a surface. The switch mechanism disengages and stops illuminating the container when the container and Illuminator are placed upon a surface. The invention causes a visually pleasing effect when the liquid container that the Illuminator is attached to is being used to dispense liquid. The Illuminator illuminates the liquid inside of a container and the container itself. The Illuminator is useful as a promotional or novelty item for a business or product. It is also useful for personal enjoyment and the visual effect is pleasing to observers.

2. Description of the Related Art

Products for illuminating liquid containers are well know in the art. For example, bottle glorifiers as frequently seen in restaurants and bars (as seen on www.creativemag.com/plast1102.html, last visited Feb. 12, 2005) are described in U.S. Pat. No. 4,344,113. These glorifiers are designed to illuminate a bottle while the bottle is resting on top of the glorifier. Moreover, these glorifiers are designed to act as a pedestal upon which the bottle rests. Further, U.S. Pat. No. 6,065,848 and application #20030076672 describe illumination devices that attach to the base of a bottle. These illumination devices operate with a manual switch and do not work automatically. The present invention improves upon the prior art in that the Illuminator automatically illuminates the liquid container and any liquid contained therein when the container that is attached to the Illuminator is lifted from a surface. It ceases illuminating the liquid container and any liquid contained therein when the container that is attached to the Illuminator is returned to a surface.

BRIEF SUMMARY OF THE INVENTION

This invention relates to an apparatus that attaches to the base of a liquid container due to a high level of friction between an outer surface of the liquid container and the Illuminator's high friction, liquid-proof outer coating. The Illuminator automatically illuminates the liquid inside of a container and the container itself when the liquid container and attached Illuminator are lifted from a surface. The Illuminator can be utilized to create a variety of attractive and desirable visual effects. One embodiment of the present invention is to have an Illuminator that illuminates the liquid contained within the container and the container itself when the container is lifted from a standing position. A hollow base of the Illuminator houses an electrical switch mechanism that engages when pressure is removed from the bottom of the Illuminator (e.g., the Illuminator is lifted from a surface that it had been placed on in the upright position). When the electrical switch mechanism is engaged a connection between a power source and a light source is completed and the container and any liquid contained therein is illuminated. The Illuminator illuminates the container and any liquid contained therein during the time that there is little or no pressure on the bottom surface of the Illuminator (e.g., the bottom of the Illuminator is not in contact with a surface). When the container and attached Illuminator are returned to a surface and enough pressure is restored to the bottom surface of the Illuminator (e.g., the Illuminator is placed upon a surface in the upright position), the electrical switch mechanism disengages and causes the connection between the power source and the light source to be interrupted. This causes the Illuminator to stop illuminating the container and any liquid contained therein. The present invention may be understood in greater detail to the drawings, the brief description of the drawings, and the detailed description of the invention.

BRIEF DESCRIPTION OF THE SEVERAL VIEWS OF THE DRAWINGS

The drawings represent the preferred embodiment of the Automatic Base-Mounted Container Illuminator.

DETAILED DESCRIPTION OF THE INVENTION

Figure 1:
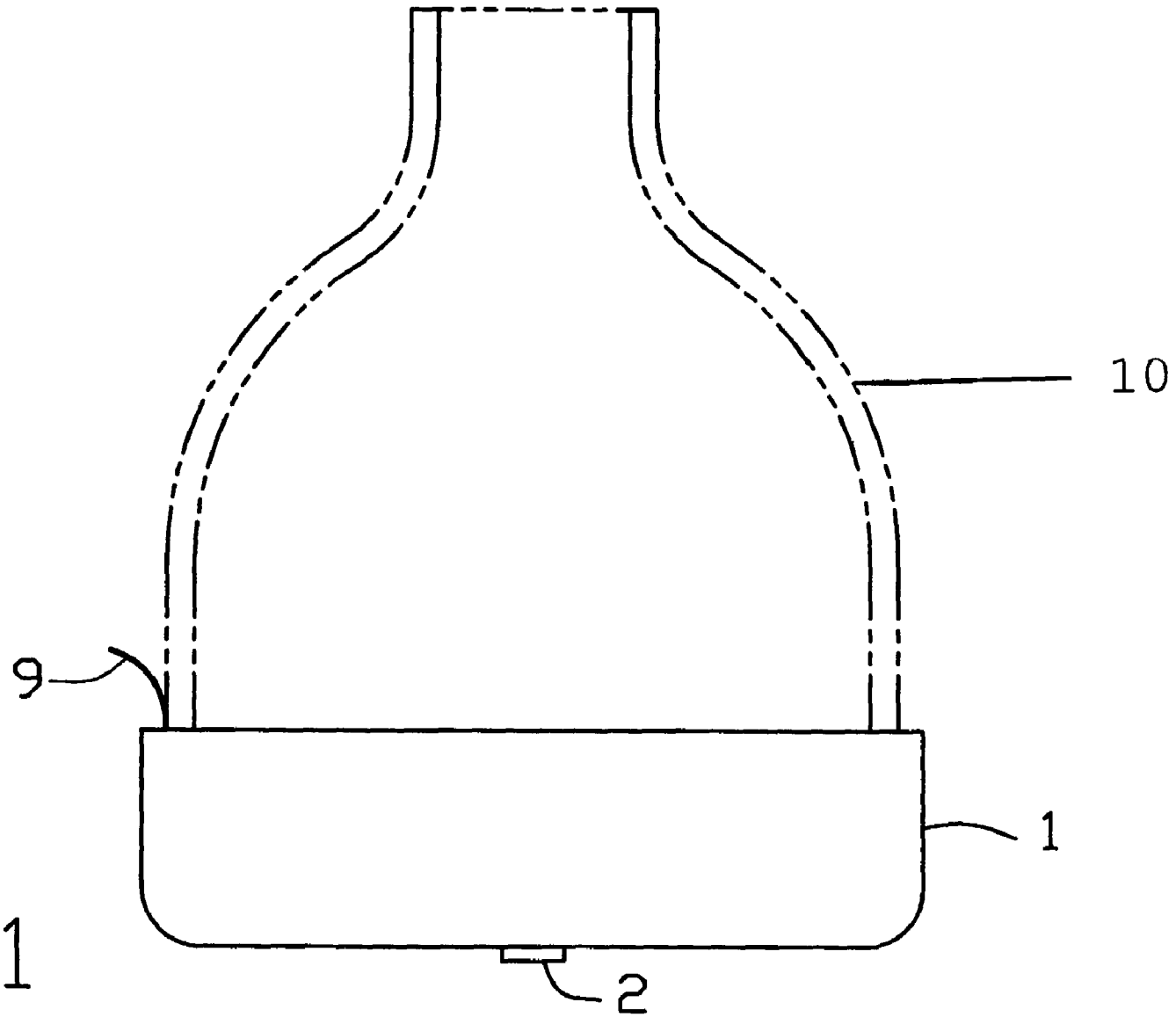
FIG. 1 is a side view of the Automatic Base-Mounted Container Illuminator.
Figure 2:
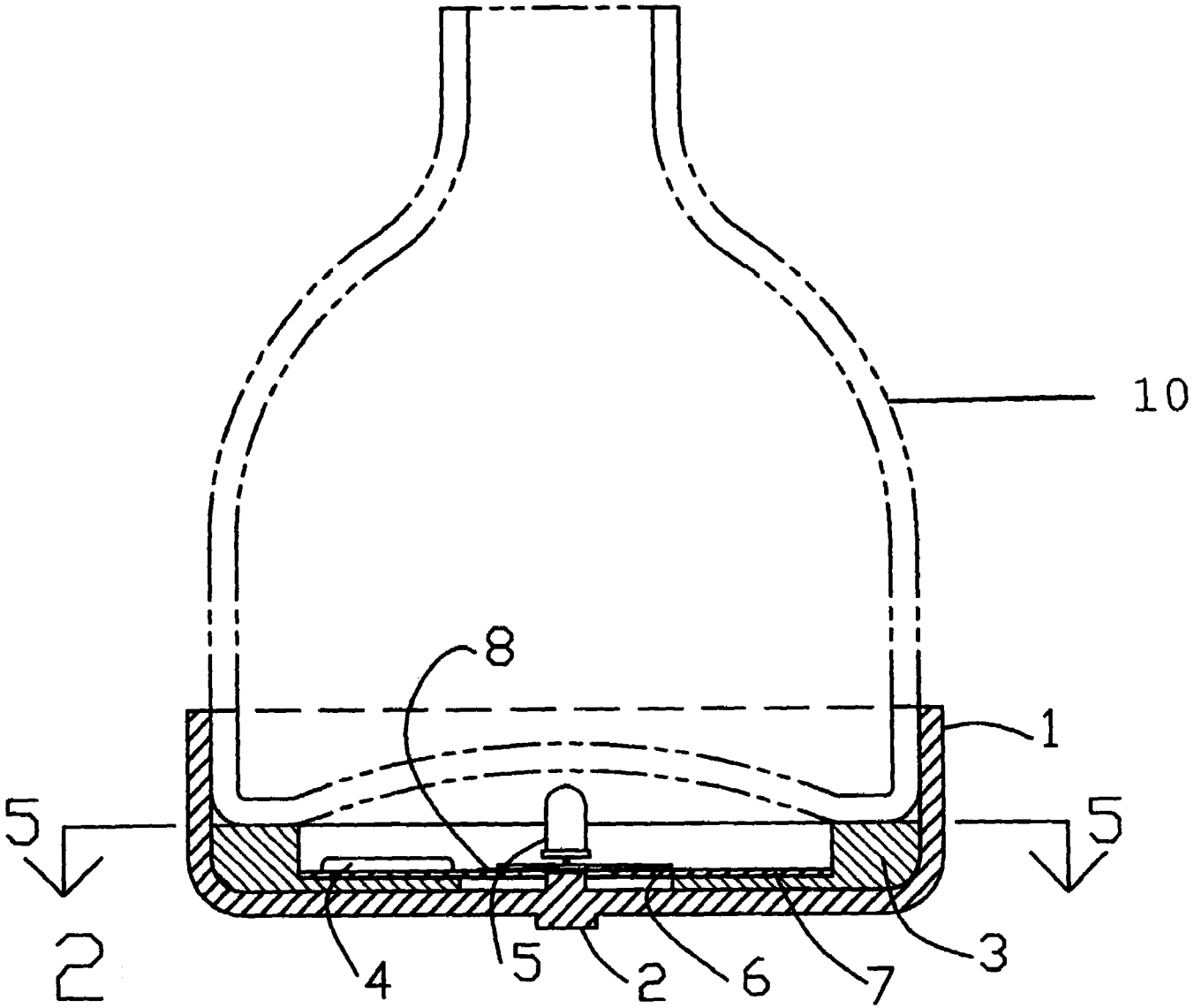
FIG. 2 is a cross-sectional view of the Automatic Base-Mounted Container Illuminator in the engaged position containing sectional line 5, which corresponds to the sectional drawings in FIG. 5.
Figure 3:
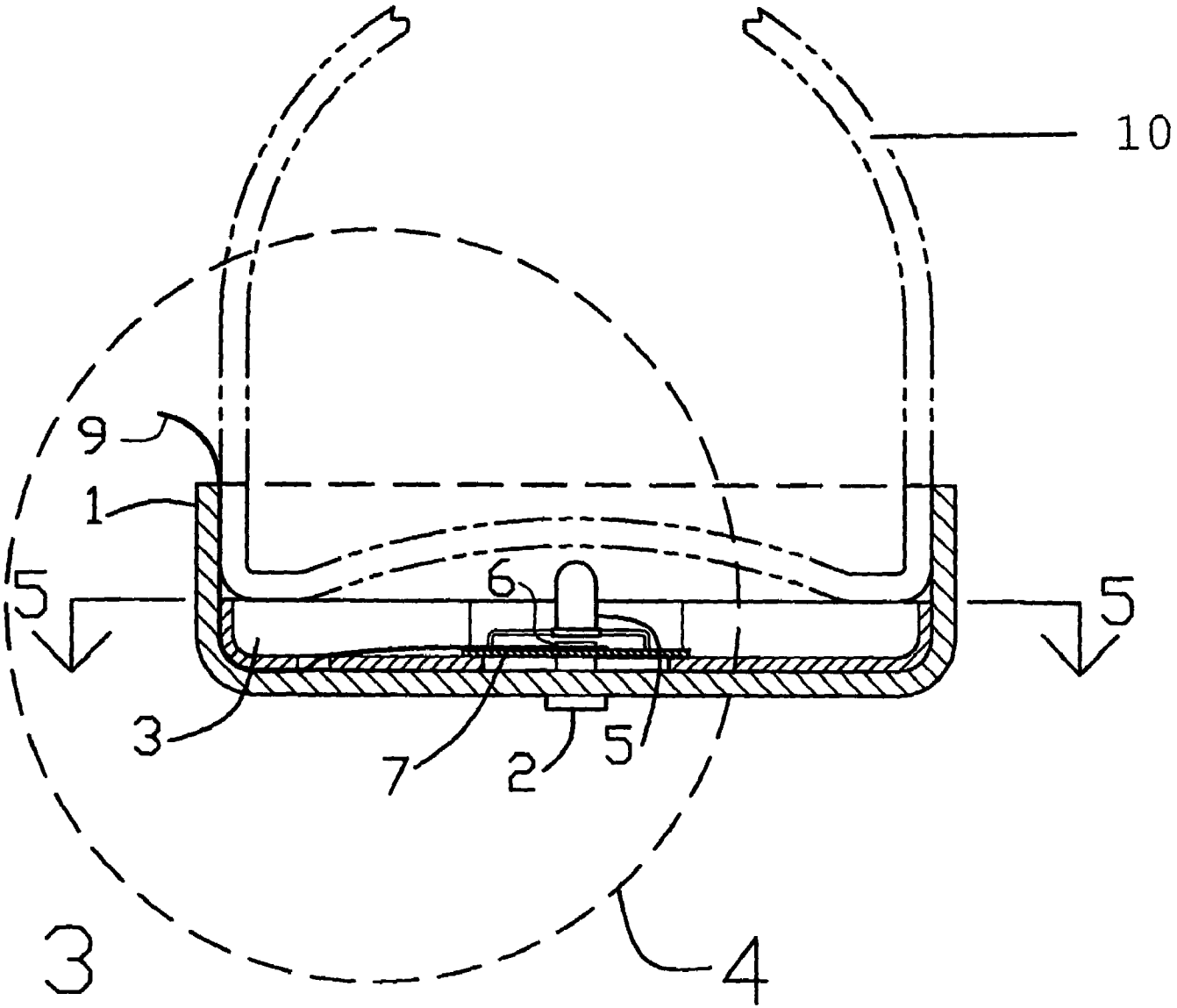
FIG. 3 is a cross-sectional view of the Automatic Base-Mounted Container Illuminator in the commercially packaged disengaged position, and contains line 4 which corresponds to FIG. 4.
Figure 4:
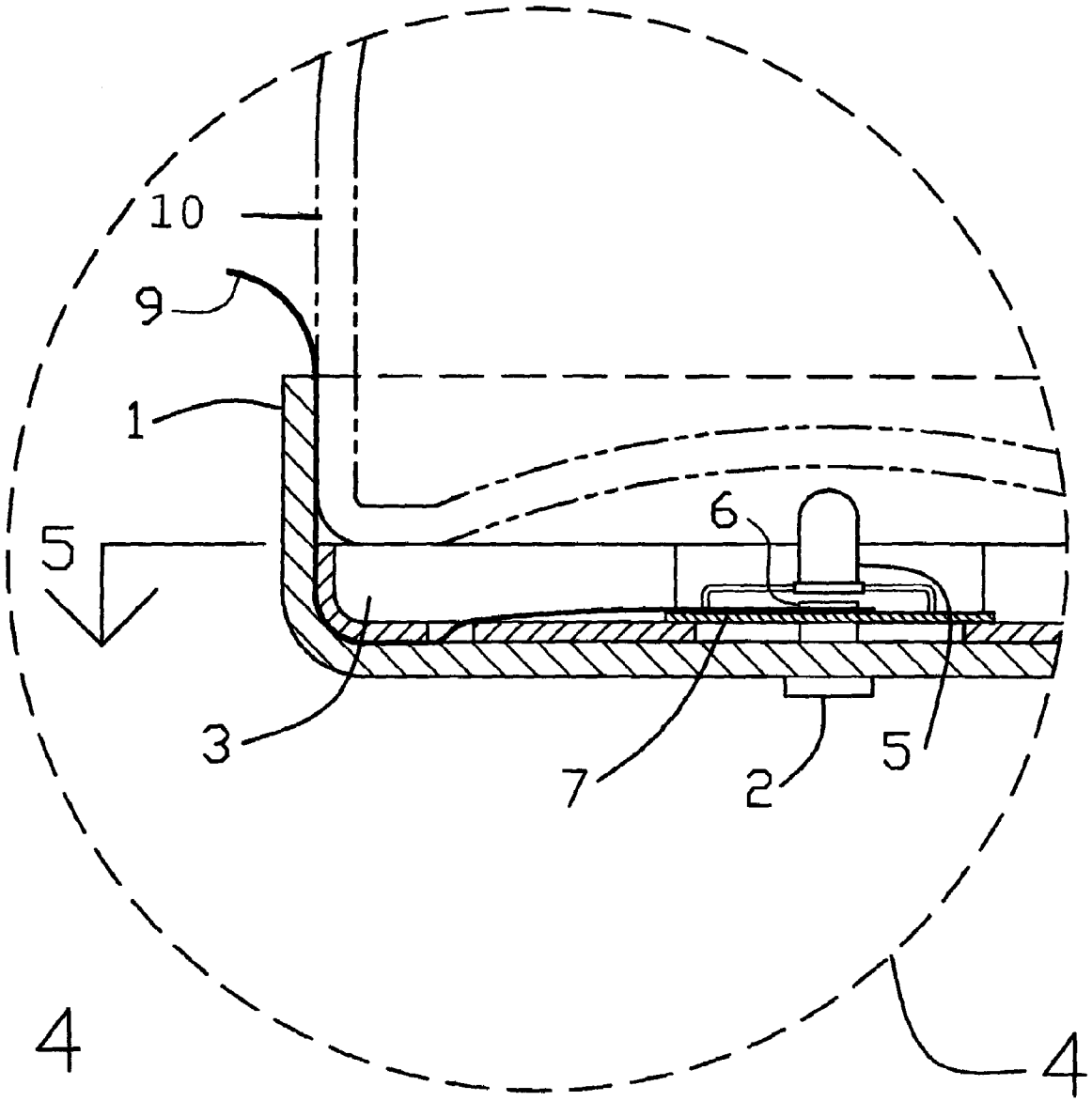
FIG. 4 is an exploded view of the Automatic Base-Mounted Container Illuminator in the commercially packaged disengaged position.
Figure 5:
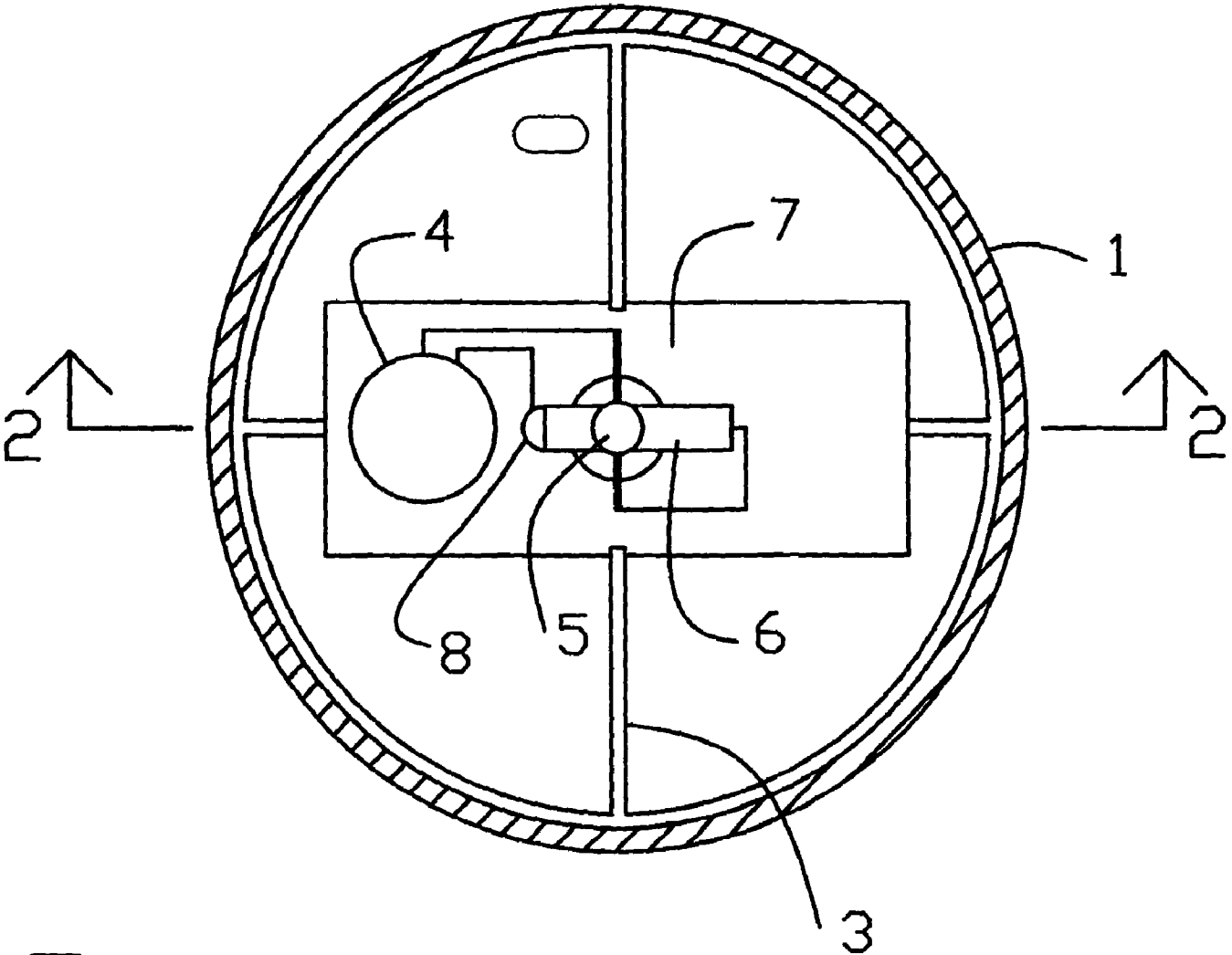
FIG. 5 is a top-sectional view of the Automatic Base-Mounted Container Illuminator in the engaged position, visually oriented and directed downward in the hollow base of the Automatic Base-Mounted Container Illuminator, and contains sectional line 2 which corresponds to FIG. 2.
Figure 6:
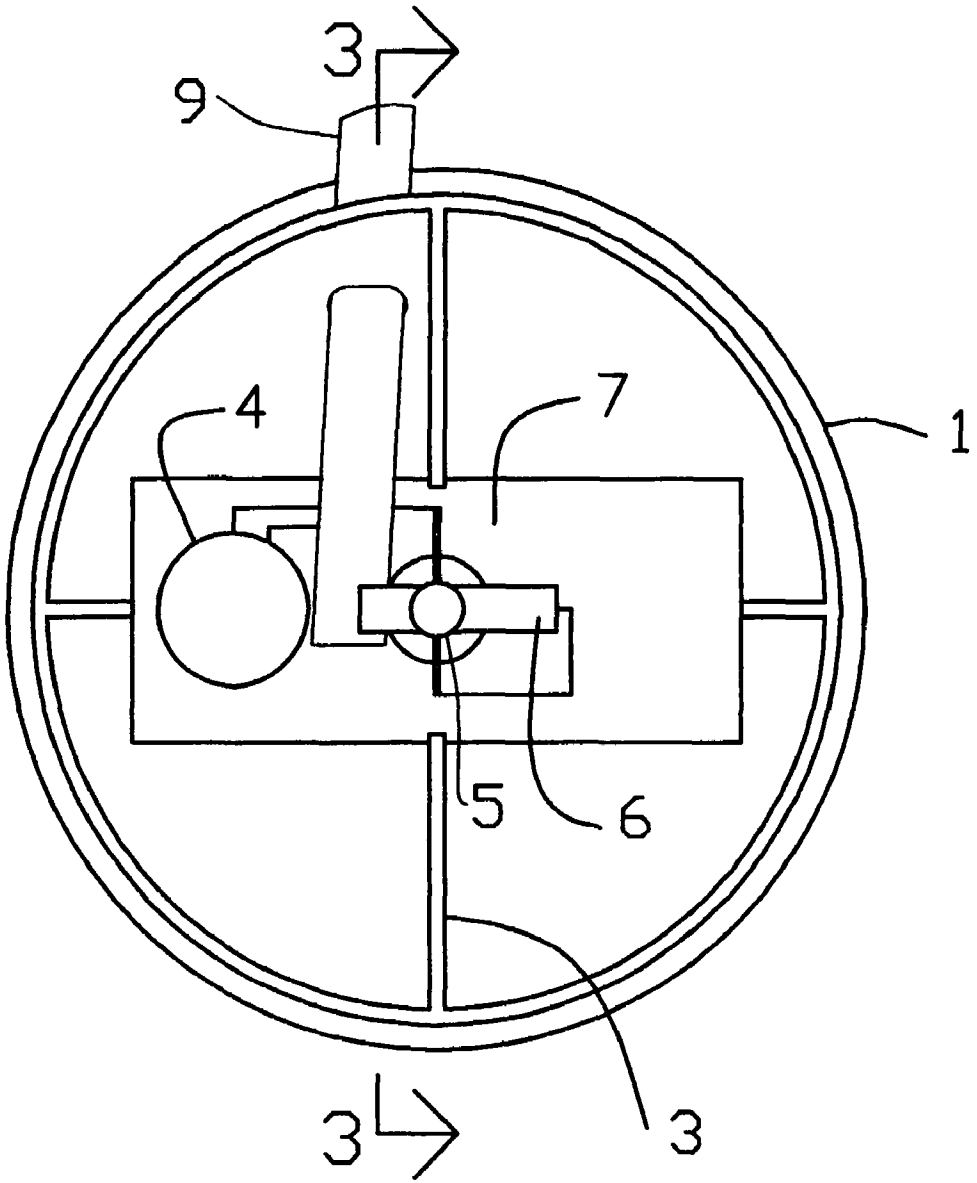
FIG. 6 is a top-sectional view of the Automatic Base-Mounted Container Illuminator in the commercially packaged disengaged position, visually oriented and directed downward in the hollow base of the Automatic Base-Mounted Container Illuminator, and contains sectional line 3 which corresponds to FIG. 3.
Figure 7:
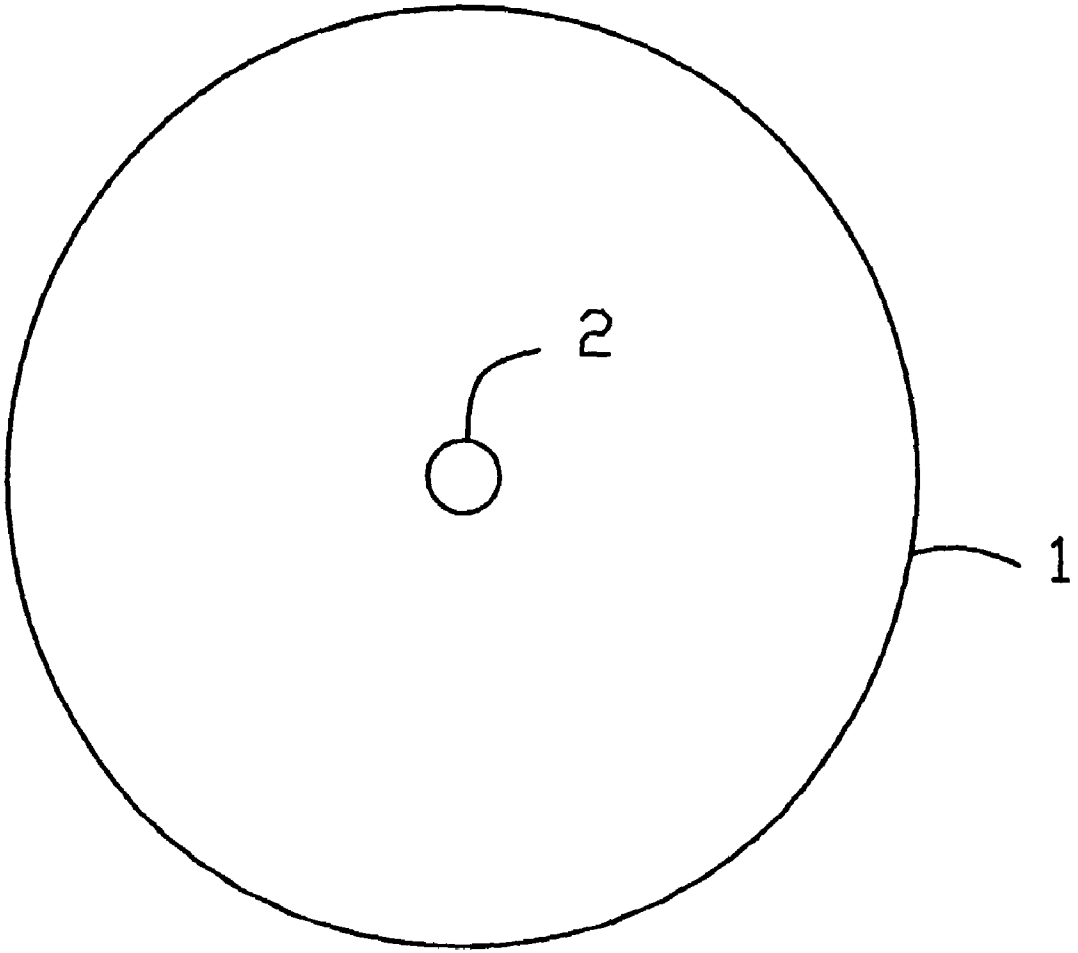
FIG. 7 is a bottom view of the Automatic Base-Mounted Container Illuminator.

The drawings represent the preferred embodiment of the Automatic Base-Mounted Container Illuminator. The Illuminator attaches to liquid container (10) by having high friction, liquid-proof outer coating (1) bear elastically and grip the outer wall of liquid container (10) creating a high level of friction that causes the Illuminator to remain secured to liquid container (10). Packaging ribbon (9) prevents leaf switch (6) from engaging the electrical circuit between power source (4) and light source (5) prior to first use. This is because packaging ribbon (9) is a removable nonconductive material positioned below leaf switch (6) and above one or more electrical contacts (8), located on PC board (7). When packaging ribbon (9) is removed, leaf switch (6) extends downward and completes the circuit because it contacts one of the electrical contacts (8), unless and until button switch (2) is depressed. Button switch (2) is a molded protrusion on the surface of liquid proof outer coating (1) that is positioned below leaf switch (6). Depression of button switch (2) causes leaf switch (6) to move upward and break the circuit between light source (5) and power source (4), because the button extends upward through an opening in inner housing (3) to come in contact with leaf switch (6).

The foregoing description is intended to serve as an example of the invention in one of its preferred embodiments and is not intended to limit the scope of the invention in any way.

We claim:

1. A base-mounted apparatus for automatically illuminating a liquid container and any liquid contained therein comprising: a hollow base; a light source within the hollow base; an electric power source within the hollow base; an electrical switch mechanism within the hollow base connected to the light source and the power source; a liquid-proof, high friction outer coating in contact with the hollow base; said hollow base comprising of an upper surface with an opening, and a lower surface with an opening; said hollow base further comprising a means for securing the power source; a means for securing the light source directly below the opening in the upper surface; and a means for securing the electrical switch mechanism; said liquid-proof, high friction outer coating comprising a lower surface; one or more surfaces extending upward from the lower surface to form one or more walls; and a protrusion on the lower surface that extends both upward into the opening on the lower surface of the hollow base and downward from the lower surface of the liquid-proof, high friction outer coating; said electrical switch mechanism comprising a PC board that has an upper surface and a lower surface, an electrical contact for the power source located on the upper surface, an electrical contact for the light source located on the upper surface, and an opening positioned directly above the opening in the lower surface of the hollow base; and a conductive leaf switch positioned above the opening in the PC board.

2. A base-mounted apparatus for automatically illuminating a liquid container and any liquid contained therein as in claim 1 wherein the conductive leaf switch comprises: an attachment end and a completion end, said attachment end being attached to the upper surface of the PC board at the electrical contact for the power source, and said completion end being positioned directly upon the electrical contact for the light source.

3. A base-mounted apparatus for automatically illuminating a liquid container and any liquid contained therein as in claim 1 wherein the conductive leaf switch further comprises: an attachment end and a completion end, said attachment end being attached to the upper surface of the PC board at one electrical contact, and said completion end being positioned directly upon another electrical contact on the PC board; and a removable nonconductive material that is positioned between the completion end of the leaf switch and the electrical contact for the light source.

* * * * *